US007427997B2

(12) United States Patent
Mongeon

(10) Patent No.: US 7,427,997 B2
(45) Date of Patent: Sep. 23, 2008

(54) SYSTEMS AND METHODS FOR REGISTERING A SUBSTRATE

(75) Inventor: Michael C. Mongeon, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 345 days.

(21) Appl. No.: 11/138,340

(22) Filed: May 27, 2005

(65) Prior Publication Data

US 2006/0268092 A1 Nov. 30, 2006

(51) Int. Cl.
*B41J 2/435* (2006.01)
*G03G 15/01* (2006.01)

(52) U.S. Cl. ..... 347/116; 399/301

(58) Field of Classification Search ..... 347/116; 399/301

See application file for complete search history.

(56) References Cited

U.S. PATENT DOCUMENTS 4,826,148 A 5/1989 Coons, Jr.
6,275,244 B1 8/2001 Omelchenko et al.
6,667,756 B2 * 12/2003 Conrow et al. ..... 347/248
6,806,896 B2 * 10/2004 Conrow et al. ..... 347/248

* cited by examiner

*Primary Examiner*—Huan Tran
(74) *Attorney, Agent, or Firm*—Oliff & Berridge, PLC

(57) ABSTRACT

A Xerographic system includes an imaging device that forms an image on a substrate and a controller that applies one-half of a substrate error value as a correction value to adjust a position of the image prior to the imaging device forming the image on the substrate. A method of adjusting an image on a substrate including determining a substrate error and applying one-half of the substrate error value as a correction value to adjust a position of the image on the substrate prior to forming the image on the substrate.

20 Claims, 8 Drawing Sheets

SYSTEMS AND METHODS FOR REGISTERING A SUBSTRATE

BACKGROUND

Duplex printing forms an image on both sides of an image receiving substrate or sheet of paper. Duplex printing may be performed using a system that forms images on both sides of a sheet at a single transfer station. In some duplex printing systems, the sheet is inverted after the sheet has received a first image on a first side by passing the sheet through the transfer station. A second image is then formed on a second side of the sheet by passing the inverted sheet through the same transfer station.

It can be difficult to position the first image on the first side of the sheet in a manner that coincides with the position of the second image on the second side of the sheet. Registration of the first image with the second image is not always accurate because one or more registration errors offset the first image relative to the second image. For example, a page number printed on the bottom-center position of the first side of a two-sided, printed document should align exactly with the page number printed on the reverse side. However, in many instances, the page numbers are printed offset from each other. The offset of the page number on the second side of the sheet with respect to the page number on the first side of the sheet is the result of a registration error that is extremely undesirable, and considered unacceptable in various printing industries.

Although registering the two images on the front and backsides of the sheet of paper can be difficult, the alignment is essential in industries such as the offset printing industry. In this industry, duplex sheets are sometimes produced having a number of pages that compose a single, multi-page document. To create the multi-page document, the sheet of paper is printed with multiple images on the front and backside of a single composite sheet, and the images are aligned on the front and back of the single sheet of paper. The single composite sheet is subsequently folded and segmented into individual pages. Each of the images on a first side a sheet must therefore be registered with a corresponding image on a second side of the sheet before the sheet may be segmented into individual pages.

Specifically, the first image that is formed on the first side of the sheet and the second image that is formed on the second side of the sheet are positioned so that identical images printed on both sides of the sheet are coincident with each other. For example, two identical images printed on both sides of a sheet of paper may form mirror images of each other if each image is printed with no intentional offset from the other. Thus, an image on the front side of the sheet would appear to be in perfect or transparent registration with the corresponding image on the backside of the sheet.

To ensure proper registration, it is essential that the position of the image receiving substrate be precisely controlled. Active registration systems are well know that sense a position of a sheet, and operate to correct the position of the sheet, if necessary, before an image is transferred to the sheet. However, even if the position of the sheet is controlled, errors in magnification make achieving such transparent registration difficult. The errors can be attributed to the operating speed of an image carrier, such as a photoreceptor belt or drum. Magnification errors can also be attributed to the frequency at which a write clock or a pixel clock operates. Another source of magnification errors is the expansion or contraction of paper, coupled with variation in properties from sheet to sheet. In order to correct such magnification errors, the speed of the photoreceptor belt or drum, or other such device, is adjusted, and the pixel clock frequency is adjusted.

SUMMARY

A "show-through" error may occur when the proper registration is not performed correctly. An amount of show-through error can be determined by measuring the displacement between two points on the substrate, e.g., one on a first side of the sheet and one on a second side of the sheet, that are intended to be equidistant from a common sheet edge. The portion of the error associated with paper shrinkage is often caused by fusing a printed first image on the first side prior to printing a second image on the second side. Because of the registration errors discussed above, which sometimes occur when using a wide range of paper types with very specific performance specifications, there is a need for systems and methods that reduce registration errors produced in reproduction systems.

Before a registration setup operation is performed, errors may exist in the photoreceptor belt or drum speed and the pixel clock frequency. These errors may result in process and lateral magnification errors, respectively, as the image is exposed on the photoreceptor belt or drum. The process direction is the direction in which a sheet moves through a printing system, or the direction parallel to movement from the leading edge to the trailing edge of the sheet. The lateral direction is perpendicular to the process direction. The process magnification error is magnification error in an image measured in the process direction, and lateral magnification error is magnification error in an image measured in the lateral direction.

After the image is transferred, the image is subsequently fused to a substrate, for example, a sheet of paper. The sheet of paper (and the image on the sheet) shrinks, thereby compounding the magnification errors. There is no direct way to differentiate between the original photoreceptor belt or drum speed error, the pixel clock frequency error and the error caused by shrinkage. Also, because the first-formed image passes through the fuser one more time than the second-formed image, there is also a difference between the magnification error in the image on the first side of the sheet and the magnification error in the image on the second side of the sheet.

The photoreceptor belt or drum speed, and the pixel clock frequency, may be adjusted during the setup operation to correct for the magnification errors. Since this adjustment accounts for both machine error and shrinkage error, there are intentional residual errors (referred to herein as residual magnification errors) that remain for both the photoreceptor belt or drum speed and the pixel clock frequency. The residual errors are permitted to remain to ensure that the resultant images on a sheet, after accounting for the paper shrinkage during fusing, are the correct size. Due to residual errors, the first and second images formed on the photoreceptor belt or drum after the setup adjustments would, if measured, have a magnification error.

The residual error has a linearly increasing effect on registration when moving from the leading edge of a sheet to the trailing edge of the sheet in the process direction and from the Start-of-Scan (SOS) sensor to the End-of-Scan (EOS) sensor in the lateral direction. In some printing systems, registration occurs at the outboard edge and the leading edge of the sheet for the first side, and at the outboard edge and the trailing edge of the sheet for the second side. In such devices, the residual magnification errors can affect process registration on the second side.

After the magnification errors have been corrected using the setup operation, any existing show-through error must be corrected. The show-through may be caused by imprecise substrate sizes and the speed of the photoreceptor belt or drum. The amount of show-through error existing may be determined by using a running average of multiple sheets, and assuming that the paper size variation within a plurality of paper sheets, e.g., a carton of paper, is smaller that the paper sheets contained in two different cartons or between various brands.

A Xerographic system may include an imaging device that forms an image on a substrate and a controller that applies one-half of a substrate error value as a correction value to adjust a position of the image prior to the imaging device forming the image on the substrate.

A method of adjusting an image on a substrate may include determining a substrate error and applying one-half of the substrate error value as a correction value to adjust a position of the image on the substrate prior to forming the image on the substrate.

In various exemplary embodiments, the systems and methods may reduce or eliminate the show-through error during the image to paper reproduction. The systems and methods may use sensors to determine the leading and trailing edges of a sheet, and then determine an estimated page length of the sheet. Then, the systems and methods adjust the leading edge registration by applying a correction to the page synch signal equal to one half of the theoretical page size error. The adjustment is performed using SOS counts from the raster output scanner (ROS) to adjust the leading edge registration by a precise amount.

A paper size variation may be reasonably constant over a certain "batch" of paper, but the paper size variation may vary from "batch to batch" of paper. Thus, the systems and methods may also correct the variation that varies from batch to batch.

BRIEF DESCRIPTION OF THE DRAWINGS

Various exemplary embodiments of the systems and methods according to the invention will be described in detail, with reference to the following figures, wherein.

DETAILED DESCRIPTION OF EMBODIMENTS

Figure 1:
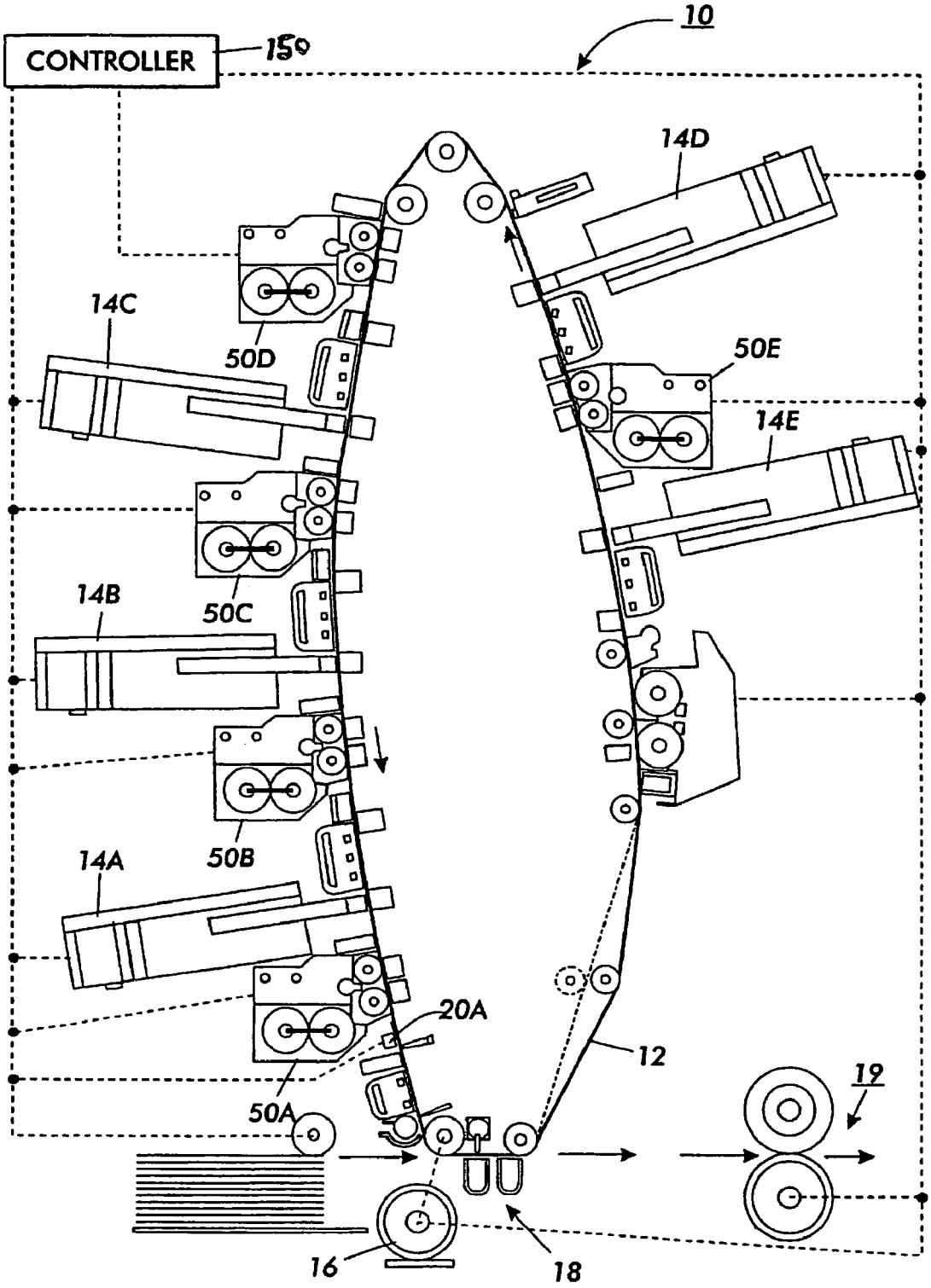
FIG. 1 is an exemplary diagram of a reproduction system that incorporates a registration system.

FIG. 1 is an exemplary diagram of a reproduction system 10 that incorporates a registration system. It should be appreciated that the reproduction system 10 in FIG. 1 is shown for exemplary reasons and that any known reproduction system, e.g., using a photoreceptor belt or drum system, may incorporate the registration systems and methods discussed below.

As shown in FIG. 1, the reproduction system 10 may include a single photoreceptor belt 12 that is successively charged, ROS (raster output scanner) imaged, and developed with black and/or any or all primary colors toners by a plurality of imaging stations. In this example, the plurality of imaging stations include respective ROS's 14A, 14B, 14C, 14D, and 14E and associated developer units 50A, 50B, 50C, 50D, and 50E. The reproduction system 10 may include at least one sensor 20A that includes detectors for sensing registration parameters of the substrate. Additional sensors may be positioned within the reproduction system 10 in various locations.

The belt 12 may have a conventional drive system 16 for moving it in the process direction shown by its movement arrows. A conventional transfer station 18 may also be included that transfers the images to the substrate, usually a paper sheet, which may then be fed to a fuser 19 and outputted. The belt 12 may be any known photoreceptor belt. The reproduction system 10 may include a control system 150 that may be used to control operation of the reproduction system 10 including the registration process.

Figure 2:
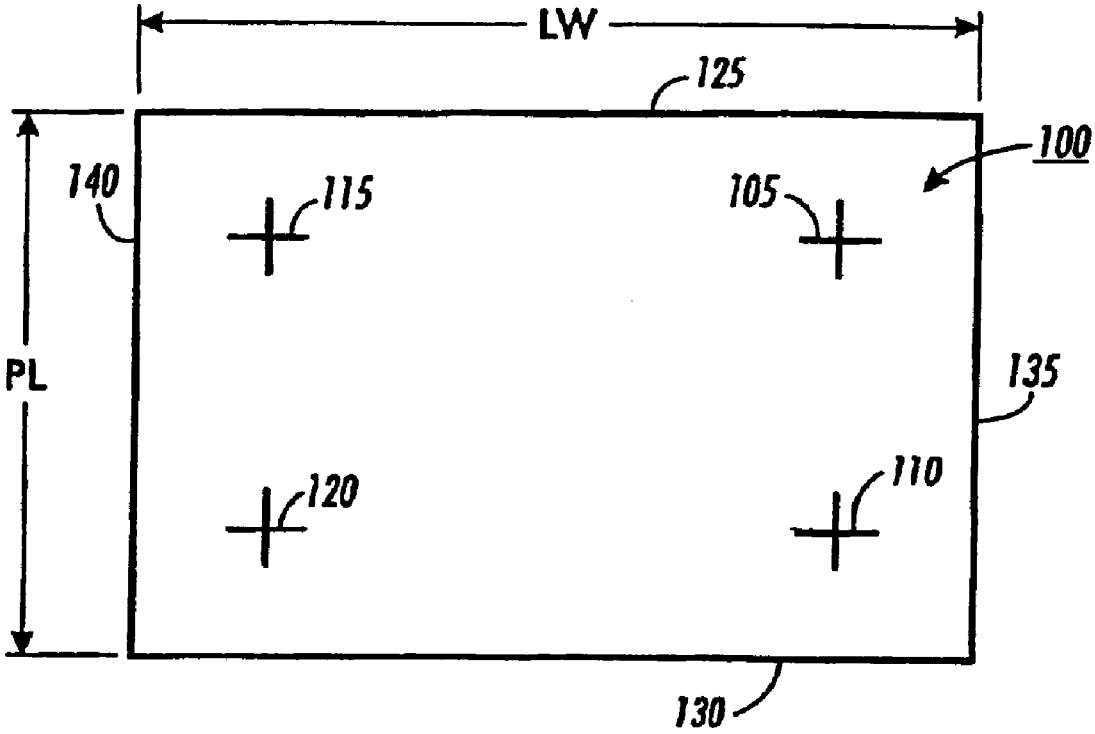
FIG. 2 is an exemplary diagram of a substrate that includes a registration test pattern.

FIG. 2 is an exemplary diagram of a substrate that includes a registration test pattern. Although the substrate in FIG. 1 is shown as a sheet of paper 100, it should be appreciated that the substrate may be any medium that receives an image. For the purpose of description only, the horizontal and vertical axes of the sheet 100 are referred to relative to the direction that the sheet moves through a printing system. The process length (PL) is the length of an edge of the sheet 100 that runs parallel to the direction that the sheet 100 is fed through a printing system. The lateral width (LW) of the sheet 100 is the length of an edge of the sheet 100 that runs perpendicular to the direction that the sheet 100 is fed through a printing system.

The four edges of the sheet 100 may also be described relative to the direction that the sheet 100 moves through the printing system. The outboard edge 135 and the inboard edge 140 are the edges that define the process length. The outboard edge 135 may refer to the edge of the sheet 100 that is closest to the registration surface of the printing system, and the inboard edge 140 to the opposite edge, i.e., the edge that is farthest from a registration surface. The leading edge 125 and the trailing edge 130 may be the edges that define the lateral width of the sheet 100. The leading edge 125 may be the forward edge as the sheet 100 moves through the printing system, and the trailing edge 130 may be the opposite edge.

Also, solely for the purpose of description, margin corrections towards different edges of the sheet 100 may be assigned positive or negative values. Adjustments towards the inboard and leading edges 140 and 125 of the sheet 100 may be assigned a negative value. Adjustments towards the outboard and trailing edges 135 and 130 may be assigned a positive value. The systems and methods may be readily applied to any duplex printing system for printing on any type of substrate, regardless of the names discussed above associated with various parts of the sheet 100.

The sheet 100 shown in FIG. 2 may include a registration test pattern with four cross-hairs 105, 110, 115 and 120 printed in the corners of the sheet 100. Various measurements of the relationship between the position of the marks 105, 110, 115 and 120 of the test pattern, and the position of the test pattern on the sheet 100 may be performed for both sides of a duplex printed sheet.

The registration test pattern may be any pattern that permits useful measurements to be made of images and their positions on the sheet 100. Any suitable known pattern that permits measurement of parameters of an image used in the reproduction systems and methods may be used as the registration test image. However, the registration test image should, for example, permit the sizes of the first side image and the second side image in the lateral and process directions to be measured and thus compared. Using the registration test pattern arrangement shown in FIG. 2, various image parameters may be measured during the setup operation, which will be discussed later. These image parameters may include, but are not limited to, image squareness, image skew, lateral magnification, process magnification and image-to-paper position.

For duplex printing, the sensitivity of the first side and second side image show-through is difficult to reduce or eliminate during the image to paper registration process. Using preference surveys, it has been determined that an observer to a sheet is sensitive when the show-through error exists. Thus, the system and methods discussed herein may reduce or eliminate the show-through error.

Figure 3:
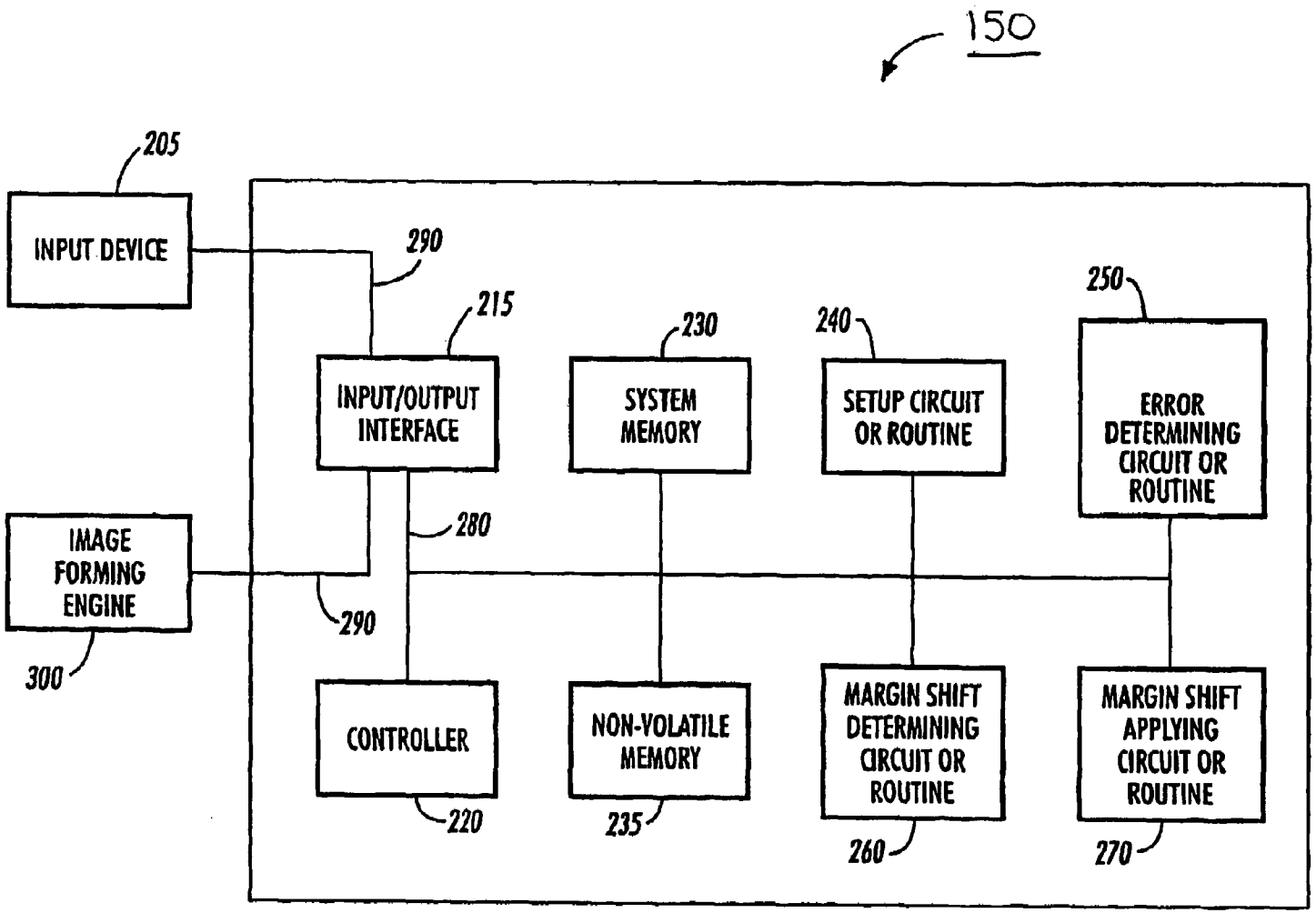
FIG. 3 is an exemplary detailed diagram of the controller shown in FIG. 1.
Figure 4:
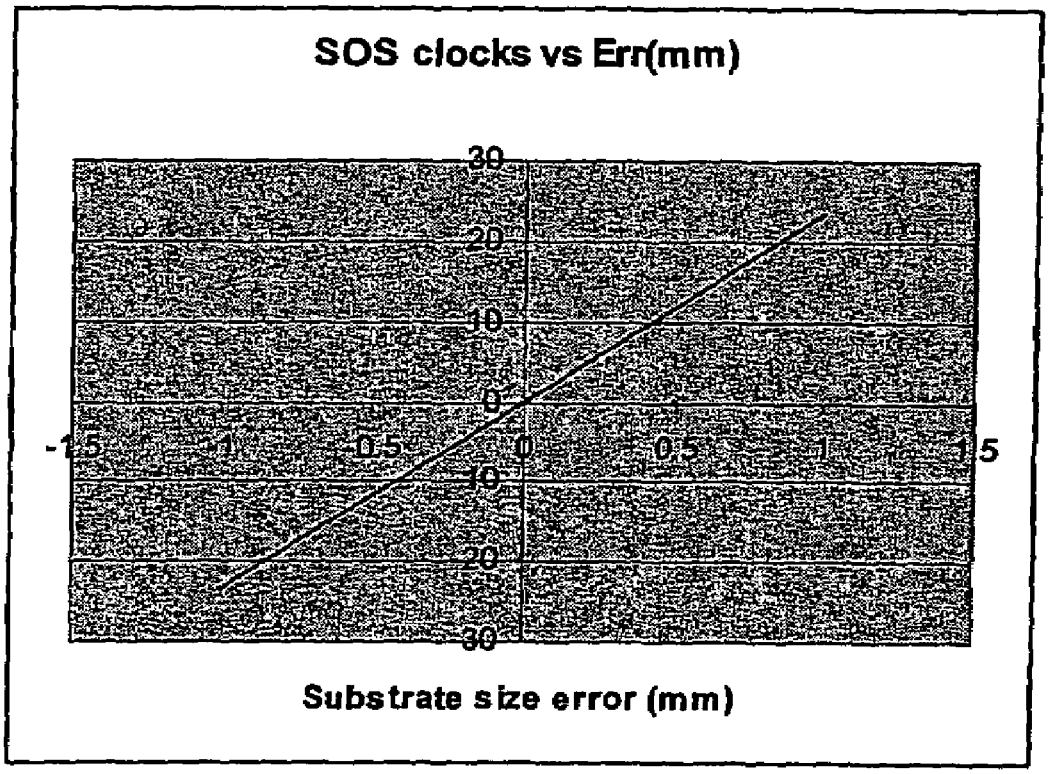
FIG. 4 is an exemplary chart that shows estimated SOS clock errors versus Err (mm)

FIG. 3 is an exemplary detailed diagram of the control system 150 shown in the reproduction system 10 in FIG. 1. The control system 150 may generate and apply margin shifts, and output the shifted image data to an image forming engine 300 based on the determined margin shifts. As shown in FIG. 3, the control system 150 may include an input/output interface 215, a controller 220, a system memory 230, a non-volatile memory 235, a setup circuit or routine 240, an error determining circuit or routine 250, a margin shift determining circuit or routine 260, and a margin shift applying circuit or routine 270, interconnected by a data/control bus or the like 280. One or more input devices 205 may be connected by a link 290 with the input/output interface 215.

As shown in FIG. 3, each of the system memory 230 and the non-volatile memory 235 may be implemented using either or both of alterable or non-alterable memory. In FIG. 3, the alterable portions of the memories 230 and 235 may be, in various exemplary embodiments, implemented using static or dynamic RAM. However, the alterable portions of each of the memories 230 and 235 may also be implemented using a floppy disk and disk drive, a writable optical disk and disk drive, a hard drive, flash memory or the like. In FIG. 3, for each of the system memory 230 and the non-volatile memory 235, the non-alterable portions of the memories 230 and 235 may be, in various exemplary embodiments, implemented using ROM. However, the non-alterable portions may also be implemented using other non-volatile memory, such as PROM, EPROM, EEPROM, an optical ROM disk, such as a CD-ROM or a DVD-ROM, and disk drive, or other non-alterable memory, or the like.

Thus, the memories 230 and 235 may each be implemented using any appropriate combination of alterable, volatile, or non-volatile memory or non-alterable or fixed memory. The alterable memory, whether volatile or non-volatile, may be implemented using any one or more of static or dynamic RAM, a floppy disk and disk drive, a writable or re-writable optical disk and disk drive, a hard drive, flash memory or the like. Similarly, the non-alterable or fixed memory may be implemented using any one or more of ROM, PROM, EPROM, EEPROM, an optical ROM disk, such as a CD-ROM or a DVD-ROM disk and disk drive or the like.

In the illustrated embodiment, the control system 150 may include a controller 220 that is implemented with a general-purpose processor. However, it will be appreciated by those skilled in the art that the controller 220 may be implemented using a single special purpose integrated circuit (e.g., ASIC, FPGA) having a main or central processor section for overall, system-level control, and separate sections dedicated to performing various different specific computations, functions and other processes under control of the central processor section.

The controller 220 may be a plurality of separate dedicated or programmable integrated or other electronic circuits or devices (e.g., hardwired electronic or logic circuits such as discrete element circuits, or programmable logic devices such as PLDs, PLAs, PALs or the like). The controller 220 may be suitably programmed for use with a general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller 220. A distributed processing architecture can be used for maximum data/signal processing capability and speed.

In general, the one or more input devices 205 may include any one or more of a keyboard, a keypad, a mouse, a track ball, a track pad, a touch screen, a microphone and associate voice recognition system software, a joy stick, a pen base system, or any other known system for providing control and/or data signals to the control system 200. The input device 205 may further include any manual or automated device usable by a user or other system to present data or other stimuli to the control system 200.

The link 290 may be any known system for connecting the input device 205 to the control system 150, including a direct cable connection, a connection over a wide area network or a local area network, a connection over an intranet, a connection over the Internet, or a connection over any other known or later-developed distributed processing network or system. In general, the link 290 may be any known connection system or structure usable to connect the input device 205 to the control system 200.

In operation, the user operates the control system 150 to cause an image forming engine to print a registration test image, such as that shown in FIG. 1, on the first and second sides of a sheet. The user then operates the input device 205 to submit measurements obtained from the registration test image to the control system 200. The measurements may include, but are not limited to, image squareness, image skew, lateral magnification, process magnification and image-to-paper position. The various measurements obtained from the registration test image may then be stored by the controller 220 in one or both of the non-volatile memory 230 and the system memory 235.

The controller 220 may access at least some of the measurements stored in one or both of the non-volatile memory 230 and the system memory 235 and supplies the accessed measurements to the setup routine or circuit 240. The setup routine or circuit 240, under control of the controller 220 and in cooperation with the image forming engine 300, adjusts the photoreceptor belt or drum speed and/or the pixel clock frequency as necessary to adjust for the average of the first side and second side magnification errors. Upon completion of the setup operation performed by the setup routine or circuit 240, the controller 220 stores the data generated by the setup circuit or routine 240, including but not limited to the nature and extent of the adjustments to the pixel clock frequency and/or the photoreceptor belt or drum speed, in one or both of the non-volatile memory 230 or the system memory 235. The adjustment data is then output under the control of the controller 220 through the input/output interface 215 by the link 290 and the data/control bus or the like 290 to the image forming engine 300.

The controller 220 then provides at least some of the data stored in one or both of the non-volatile memory 230 or the system memory 235 to the error determining circuit or routine 250. The error determining circuit or routine 250, under control of the controller 220, may determine first pass shrink rates and an amount of residual magnification error. Upon completion of the residual magnification error determining operation by the error determining circuit or routine 250, the controller 220 may store at least the values for first pass shrink rates and the amount of error determined by the error determining circuit or routine 250 in one or both of the non-volatile memory 230 or the system memory 235.

The control system 150 shown in FIG. 1 may now correct the show-through error that exists in the system. Specifically, the control system 150 may use the sensor 20A as a gate for a counter that has a source signal, for example, a 100 kHz clock. The sampling rate for the leading and trailing edge detection using the sensor 20A should be at least 100 kHz (a 10 μs period). The non-volatile memory 235 may be dynamically updated using a correction value with the units being SOS counts. Assuming that the process speed of the reproduction system is synchronized with the plurality of ROS's 14A, 14B, 14C, 14D, and 14E, then the number of scan lines per page $N_{SOS}$ may be determined using Eq. (1):

$$N_{SOS}=W*R/B \quad \text{Eq. (1)}$$

where:

W=page width;

R=printer resolution; and

B=number of beams written per scan line.

The length of the substrate is measured, and an updated number of SOS counts $N_{SOS\ MEAS}$ is determined using Eq. (2):

$$N_{SOS\ MEAS}=\mathrm{INT}(t_{page}/t_{SOS}) \quad \text{Eq. (2)}$$

where:

$t_{page}$=time elapsed from the leading edge to the trailing edge (μs); and $t_{SOS}$=time SOS period (μs).

The substrate error Err is calculated using Eq. (3) by subtracting the $N_{SOS}$ from the $N_{SOS\ MEAS}$, and the current substrate error value $NVM_{old}$ stored in the non-volatile memory 235 is obtained. An updated correction value $NVM_{new}$ is now determined using Eq. (4) by adding one-half of the determined substrate error Err to the current substrate error $NVM_{old}$ obtained from the non-volatile memory 235. The corrected value $NVM_{new}$ is stored in the non-volatile memory so that the non-volatile memory is updated.

$$\mathrm{Err}=N_{SOS\ MEAS}-N_{SOS} \quad \text{Eq. (3)}$$

$$NVM_{new}=NVM_{old}+\mathrm{Err}/2 \quad \text{Eq. (4)}$$

A running average of less than 20 sheets may be preferred in the methods in order to improve signal-to-noise ratio. If the running average is used, the maximum measurement error should be approximately 1 SOS count.

For reasons of convenience, an example of the method discussed above will now be provided using variations in multiple sheets of paper. FIG. 3 is an exemplary chart that shows estimated SOS clock counts versus the determined substrate error Err (mm). When operating a reproduction system for a long duration, an operator may feed a variety of different types of paper into the reproduction system, for example, using different cartons of paper and various brands. In this example, it is assumed that the variation within the different types of paper is ±1 mm. As shown in FIG. 3, the substrate error Err determined using the ±1 mm variation would be ±24 SOS counts. To compensate for the error, the controlling system 150 stores a correction value of one-half of the substrate error (e.g., ±24 SOS/2=±12 SOS) to a location in the non-volatile memory 235. For example, the correction data ±12 SOS may be stored in the non-volatile memory 235 at location LeadEdge_to_PageSync.

The controller 220 then accesses at least some of the data stored in one or both of the non-volatile memory 230 or the system memory 235 and provides the accessed data to the margin shift determining circuit or routine 260. The margin shift determining circuit or routine 260, under the control of the controller 220, determines margin shifts to reduce, for example, the show-through error. Upon completion of the margin shift determining operation by the margin shift determining circuit or routine 260, the controller 220 then stores the values for registration margin shift and process and lateral show through margin shifts and first and second sides determined by the margin shift determining circuit or routine 260 in one or both of the non-volatile memory 230 or the system memory 235.

The controller 220 then accesses at least some data from one or both of the non-volatile memory 230 or the system memory 235 and provides the accessed data to the margin shift applying circuit or routine 270. The margin shift applying circuit or routine 270, under the control of the controller 220, generates data usable by the image forming engine 300 and/or by the controller 220, or another controller (not shown) that controls supplying image data or desired paper position to the image forming engine 300, to adjust the image position by applying the margin shifts determined by the margin shift determining circuit or routine 260. Thus, in various exemplary embodiments, the margin shift applying data is output, under the control of the controller 220, through the input/output interface 215 over the link 290 to the image forming engine 300, or to the other controller. Alternatively, the controller 220 transfers the margin shift applying data from the margin shift applying circuit or routine 270 into the one or both of the non-volatile memory 230 or the system memory 235 for later use by the controller 220 in modifying the image data based on the determined margin shifts.

Figure 5:
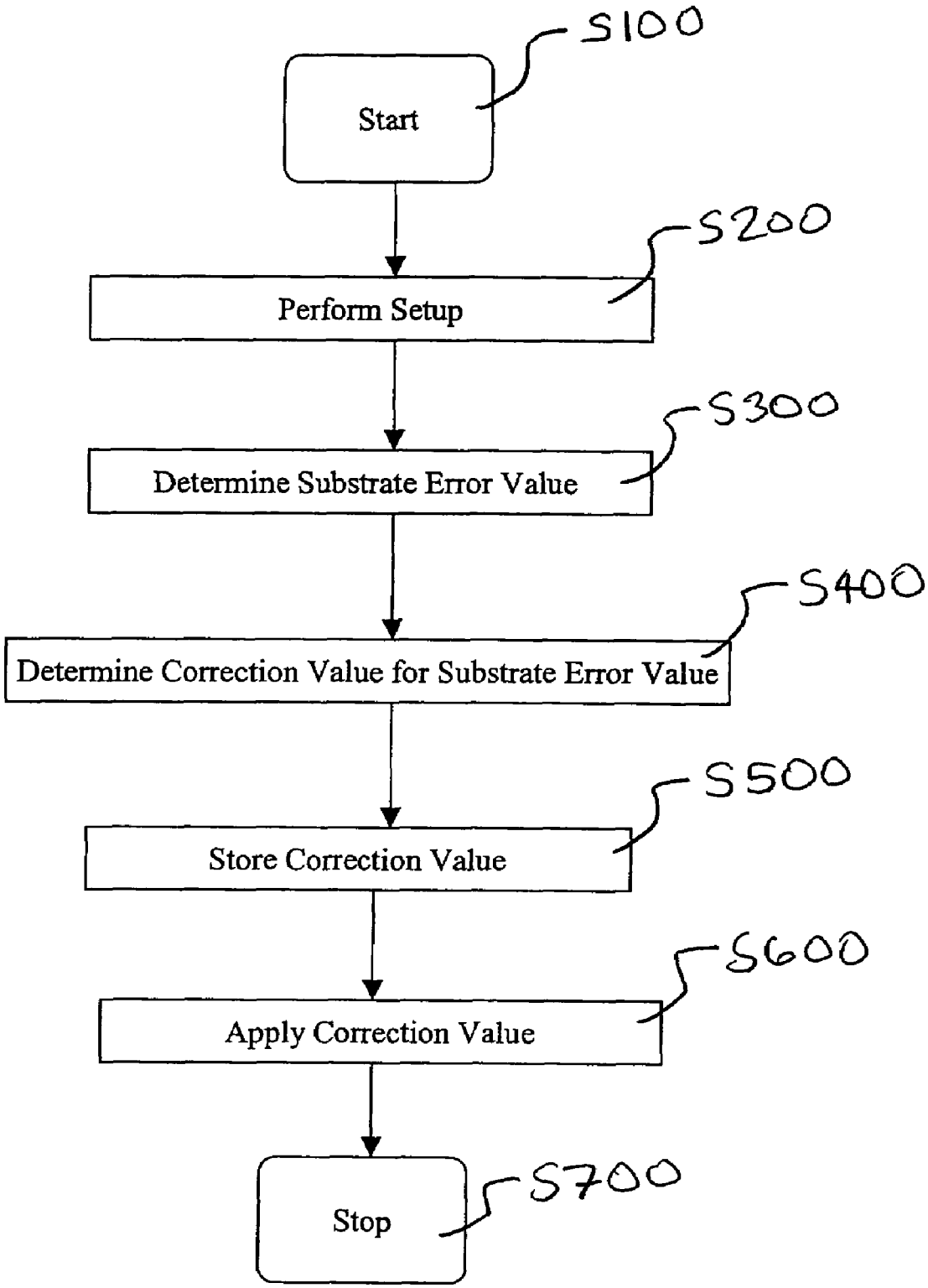
FIG. 5 is an exemplary flowchart of a method of registering the substrate.

FIG. 5 is an exemplary flowchart of a method of registering the substrate. After control starts in S100, control shifts to step S200 where a setup operation is performed on for the reproduction process. Next, in step S300, a substrate error value is determined. Control then shifts to step S400 where a correction value is determined for the substrate error. Then, in step S500, the determined correction value is stored in the memory. Next, in step S600, the correction value is applied to the reproduction process to correct the substrate error. Control then stops in step S700.

Figure 6:
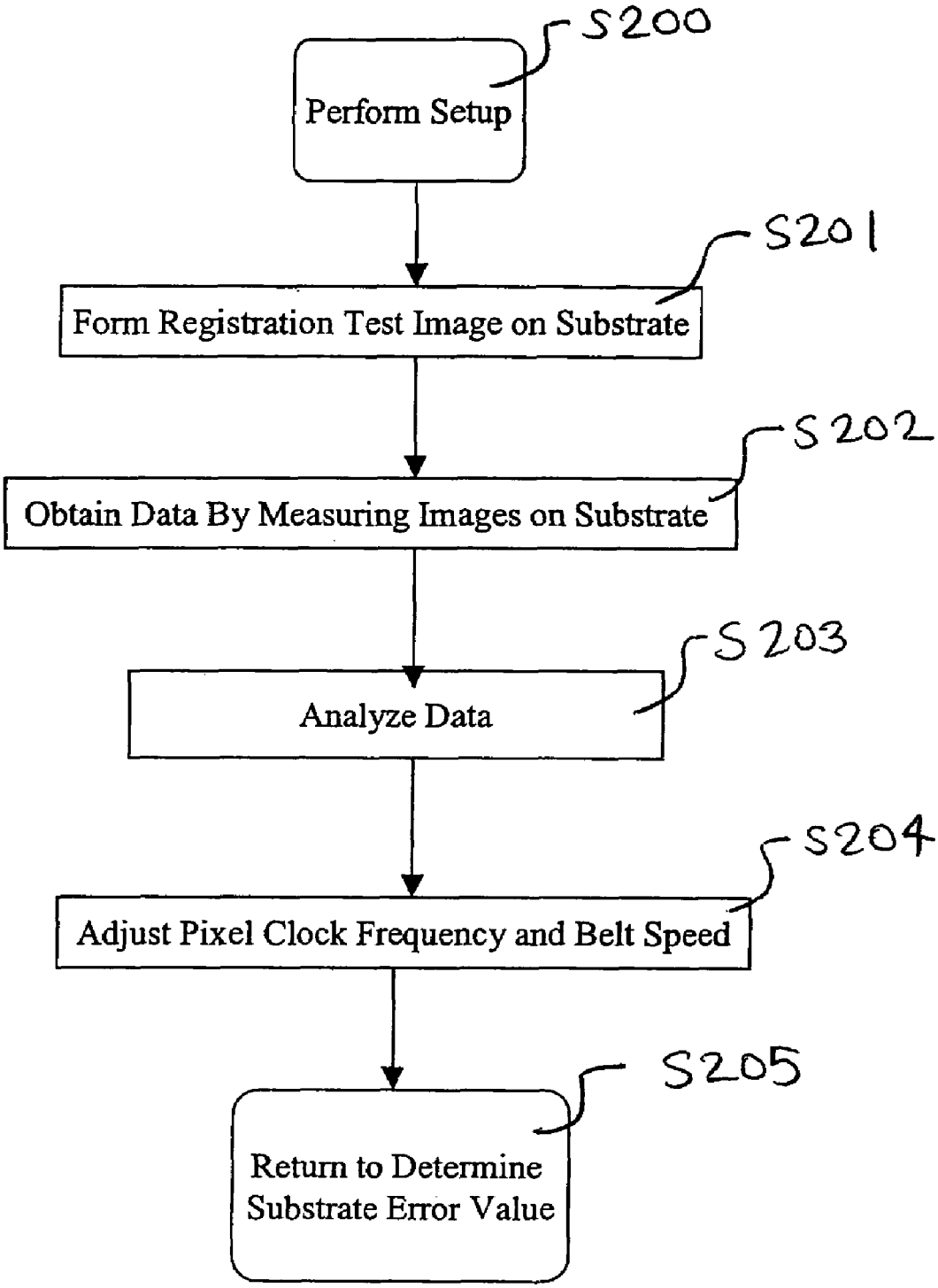
FIG. 6 is a detailed exemplary flowchart of a method of performing a setup.

FIG. 6 is a detailed exemplary flowchart of a method of performing the setup operation. After control starts in step S200, control shifts to S201 where a registration test image is printed on each of the first and second sides of the sheet. For example, the registration test image discussed with regard to FIG. 2 may be printed on the sheet. Next, in step S202, data is obtained by measuring the first image on the first side and the second image on the second side. Obtaining the data may include any suitable known method of measuring the sizes of the first and second images and determining the positions of the first and second images on the sheet. Measurements may be taken by any known manual or automated method. Similarly, obtaining the data may include storing the data into any suitable storage or memory device, including, but not limited to, electronic memory. Obtaining the data may also include accessing data that has already been obtained, stored or recorded in prior processes. Control then shifts to step S203.

In step S203, the obtained data is analyzed. Analyzing the data may include any known manual or automated process of evaluating the obtained data. Analyzing the data may include employing the data in any routine or algorithm that will provide adjustments to overcome error associated with pixel clock frequency error and photoreceptor belt or drum speed error. Operation then continues to step S204. In step S204, the pixel clock frequency and/or the photoreceptor belt or drum speed are adjusted. Adjusting the pixel clock frequency and/or the photoreceptor belt or drum speed may include any suitable known method of adjusting the pixel clock frequency and/or the photoreceptor belt or drum speed, using the adjustments obtained in analyzing the data. Adjusting the pixel clock frequency and/or photoreceptor belt or drum speed may also include any mechanical or electrical manipulations that are made to alter the pixel clock frequency and/or the photoreceptor belt or drum speed, for example, electronic or mechanical processes for implementing the adjustments. Then, in step S205, control returns to step S300.

Figure 7:
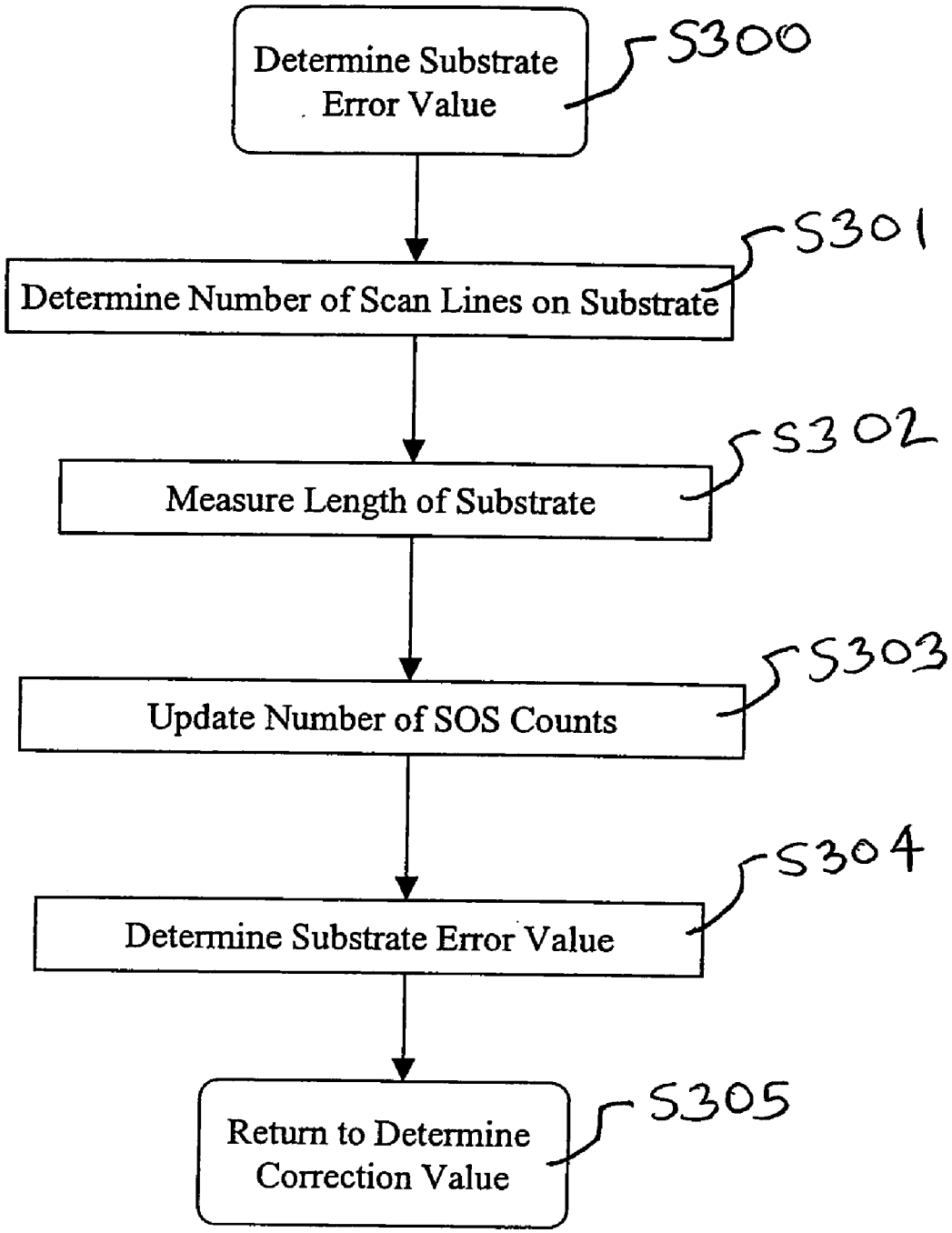
FIG. 7 is a detailed exemplary flowchart of a method of determining a substrate error.

FIG. 7 is a detailed exemplary flowchart of a method of determining a substrate error. After control starts in step S300, control shifts to step S301 where a number of scan lines on a substrate is determined. Next, in step S302, the substrate length is measured. Control then shifts to step S303. In step S303, the number of SOS counts is updated. Then, in step S304, the substrate error is determined. Control then shifts to step S305 where control returns to step S400.

Figure 8:
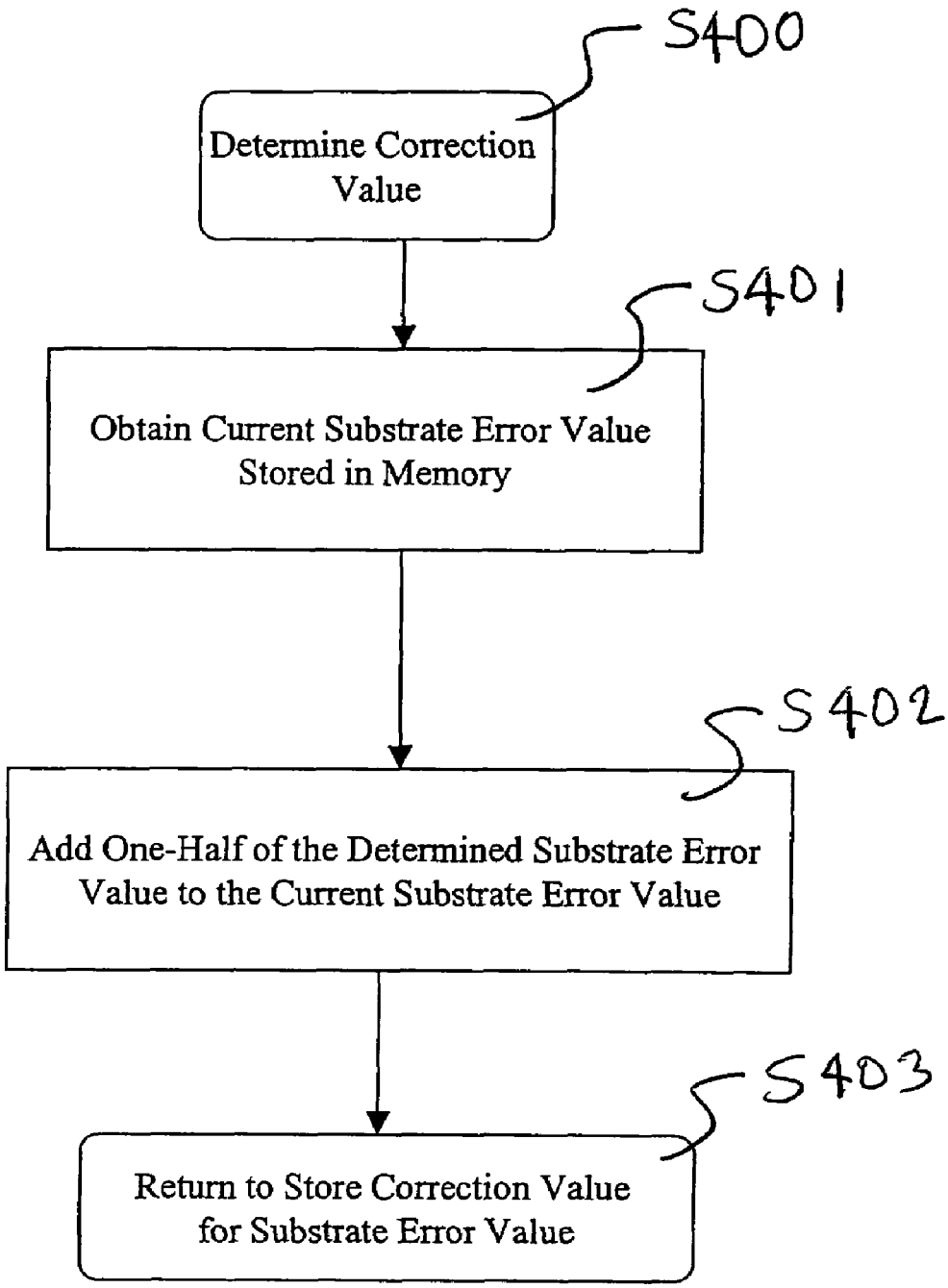
FIG. 8 is a detailed exemplary flowchart of a method of determining an amount of error correction to apply.

FIG. 8 is a detailed exemplary flowchart of a method of determining an amount of error correction to apply. After control starts in step S400, the current substrate error value stored in the memory is obtained in step S401. Then, in step S402, one-half of the substrate error determined in step S304 is added to the current error substrate error value obtained in step S401. Control then shifts to step S403 where control returns to step S500.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A Xerographic system, comprising:

an imaging device that forms an image on a substrate; and a controller that applies one-half of a substrate error value as a correction value to adjust a position of the image prior to the imaging device forming the image on the substrate.

2. The Xerographic system of claim 1, wherein the correction value is based on start of scan counts from a raster output scanner.

3. The Xerographic system of claim 2, wherein the controller uses the start of scan counts to adjust a leading edge or trailing edge registration.

4. The Xerographic system of claim 1, further comprising a memory and an error determining circuit or routine, the controller controlling the error determining circuit or routine to determine the substrate error.

5. The Xerographic system of claim 4, wherein the controller controls the error determining circuit or routine to determine a magnification error caused by at least a photoreceptor belt, drum speed or pixel clock frequency.

6. The Xerographic system of claim 5, further comprising a setup circuit or routine, the controller controlling the setup circuit or routine to adjust the photoreceptor belt, drum speed or pixel clock frequency based on the magnification error.

7. The Xerographic system of claim 1, further comprising a margin shift circuit or routine, the controller controlling the margin shift circuit or routine to adjust the image on the substrate.

8. The Xerographic system of claim 7, wherein the margin shift circuit or routine inc1udes a margin shift determining circuit or routine, the controller controlling the margin shift determining circuit or routine to determine an adjustment in the margins of the substrate.

9. The Xerographic system of claim 8, wherein the margin shift circuit or routine includes a margin shift applying circuit or routine, the controller controlling the margin shift applying circuit or routine to adjust margins of the substrate.

10. The Xerographic system of claim 4, wherein the controller controls the error determining circuit or routine number to determine a number of scan lines per page $N_{SOS}$ by using $N_{SOS}$=W*R/B, where W=page width, R=printer resolution, and B=number of beams written per scan line.

11. The Xerographic system of claim 10, wherein the controller controls the error determining circuit or routine number to an update a number of start-of-scan counts $N_{SOS\ MEAS}$ using $N_{SOS\ MEAS}$=INT ($t_{page}/t_{SOS}$), where $t_{page}$=time elapsed from the leading edge to the trailing edge (μs) and $t_{SOS}$=time SOS period (μs).

12. The Xerographic system of claim 11, wherein the controller controls the error determining circuit or routine number to determined a substrate error Err using Err=$N_{SOS\ MEAS}$−$N_{SOS}$, and determine an updated correction value $NVM_{new}$ by using $NVM_{new}$=$NVM_{old}$+Err/2, where $NVM_{old}$ is a current correction value stored in the memory.

13. A method of adjusting an image on a substrate, comprising: determining a substrate error; and applying one-half of the substrate error value as a correction value to adjust a position of the image on the substrate prior to forming the image on the substrate.

14. The method of claim 13, wherein the correction value is based on start of scan counts from a raster output scanner.

15. The method of claim 14, further comprising using the start of scan counts to adjust a leading edge or trailing edge registration.

16. The method of claim 13, further comprising determining a magnification error in at least a photoreceptor belt, drum speed or pixel clock frequency.

17. The method of claim 16, further comprising adjusting the photoreceptor belt, drum speed or pixel clock frequency based on the determined magnification error.

18. The method of claim 13, further comprising determining a number of scan lines per page $N_{SOS}$ by using $N_{SOS}$=W*R/B, where W=page width, R=printer resolution, and B=number of beams written per scan line.

19. The method of claim 18, further comprising updating a number of start-of-scan counts $N_{SOS\ MEAS}$ using $N_{SOS\ MEAS}$=INT ($t_{page}/t_{SOS}$), where $t_{page}$=time elapsed from the leading edge to the trailing edge (μs) and $t_{SOS}$=time SOS period (μs).

20. The method of claim 19, further comprising determining a substrate error Err using Err=$N_{SOS\ MEAS}$−$N_{SOS}$, and determine an updated correction value $NVM_{new}$ by using $NVM_{new}$=$NVM_{old}$=Err/2, where $NVM_{old}$ is a current correction value stored in the memory.

* * * * *